US007908773B2

(12) United States Patent
Gallay et al.

(10) Patent No.: US 7,908,773 B2
(45) Date of Patent: Mar. 22, 2011

(54) SNOWSHOE OF THE TYPE IN WHICH THE DECKING INCLUDES A PERIPHERAL FRAME

(75) Inventors: Philippe Gallay, La Clusaz (FR); Stéphane Latruffe, Annecy (FR)

(73) Assignee: TSL Sport Equipment, Alex (FR)

( * ) Notice: Subject to any disclaimer, the term of this patent is extended or adjusted under 35 U.S.C. 154(b) by 669 days.

(21) Appl. No.: 12/009,677

(22) Filed: Jan. 22, 2008

(65) Prior Publication Data

US 2008/0178494 A1 Jul. 31, 2008

(30) Foreign Application Priority Data

Jan. 26, 2007 (FR) ..... 07 00537

(51) Int. Cl.
*A43B 5/04* (2006.01)

(52) U.S. Cl. ..... 36/122; 36/124

(58) Field of Classification Search ..... 36/122–125
See application file for complete search history.

(56) References Cited

U.S. PATENT DOCUMENTS

| | | | | |
|---|---|---|---|---|
| 5,735,063 | A | 4/1998 | McManus | 36/124 |
| 5,809,668 | A * | 9/1998 | Kiniry et al. | 36/122 |
| 6,105,281 | A * | 8/2000 | Wing et al. | 36/122 |
| 2004/0250453 | A1 | 12/2004 | Settelmayer | 36/122 |

FOREIGN PATENT DOCUMENTS

| | | |
|---|---|---|
| EP | 0 931 571 | 7/1999 |

* cited by examiner

*Primary Examiner* — Marie Patterson
(74) *Attorney, Agent, or Firm* — Fay Sharpe LLP

(57) ABSTRACT

A snowshoe (1) made of a frame (2) holding a deck (3) meant to hold the user's boot, the aforementioned boot being held on the deck by a binding, characterized in that the snowshoe includes a transverse retaining element (4) extending transversely at the front of the user's foot, the aforesaid transverse element (4) being held by its lateral ends to the frame (2), while the aforementioned transverse element (4) is made of the combination of an upper transverse element (4*a*) and a lower transverse element (4*b*) so that the frame (2) is sandwiched between the ends of the respective transverse elements (4*a*, 4*b*).

16 Claims, 5 Drawing Sheets

SNOWSHOE OF THE TYPE IN WHICH THE DECKING INCLUDES A PERIPHERAL FRAME

BACKGROUND

The present invention concern a snowshoe and more particularly an improvement for snowshoes of the type in which the deck includes a peripheral frame, in which the binding configured to retain the boot is mounted on a transverse element attached to the frame.

The snowshoes, devices known for very many years, have been used for several centuries by the Scandinavian populations to move on snow. Until recently, snowshoes were used by ordinary travelers or soldiers to allow the populations and the alpine troops to move on snow for the movements required by everyday life. Currently, snowshoes are instead used by walkers or sportsmen who undertake outings and walks, and even competitions. But the sportsmen, more than those practicing for their own pleasure, are more and more demanding of the equipment which they are using, and it is true that the products actually sold do not give full satisfaction.

One knows a number of types of snowshoes and particularly the snowshoes of the type which one finds in Europe, are made up of a deck made of a plastic material on which the boot is retained. One knows also of the snowshoes of the natives of North America which are more often made of a tubular support frame holding a fabric that constitutes the deck. These snowshoes present numerous advantages and are generally relatively well adapted to the snow conditions that one encounters in that region. However it appears that these snowshoes present inconveniences particularly relative to the connection of the binding to the frame, and the attachment of snow which ends up under the metal plate including the appending cleats, which hinders good traction and is unacceptable discomfort during walking.

SUMMARY

The present invention proposes to solve the afore-mentioned problems with the aid of simple, reliable and easy to install means.

Also, the snowshoe of the invention is made up of a frame bordering a deck intended to receive the boot of the user, said boot being retained on the deck by a binding, and is characterized in that the snowshoe includes a transverse mounting element, extending transversely at the line of the front of the foot of the user, said transverse element being mounted by its lateral ends to the frame, such that said transverse element is made up of a combination of an upper transverse element and a lower transverse element so that the body so that the frame can be sandwiched between the respective ends of said transverse elements.

According to a supplemental characteristic, the two transverse elements which are attached together form at their lateral ends a mounting housing in which the frame is retained.

According to another characteristic, the snowshoe includes depending/catching means, including at least one depending/catching tooth integral with a lower plate which is sandwiched between the central wall of the upper transverse element and the central wall of the lower transverse element.

According to the embodiment described by way of example, the lower plate includes a succession of frontal teeth, formed by an extension of said plate, extending downward forming a projection downward from the general support plane of the snowshoe, also which two lateral teeth formed by the lateral extension of said lower plate, extend downward and support the general support plane of the snowshoe.

According to another supplemental characteristic, it is anticipated that at least one lower transverse element is made of plastic material, whereas the lower plate is metal.

Other characteristics and advantages of the invention will become apparent from the description which follows below and in viewing the attached drawing which are given by way of non-limiting examples.

DETAILED DESCRIPTION

Figure 1:
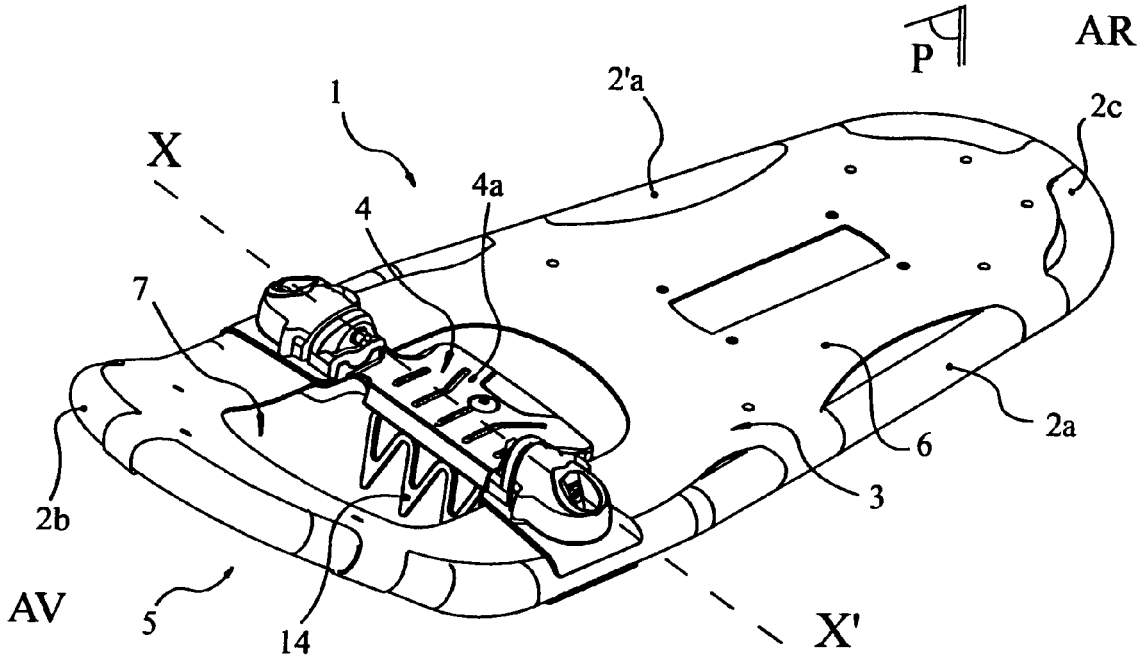
FIG. 1 is a perspective view from the front and above the snowshoe.
Figure 2:
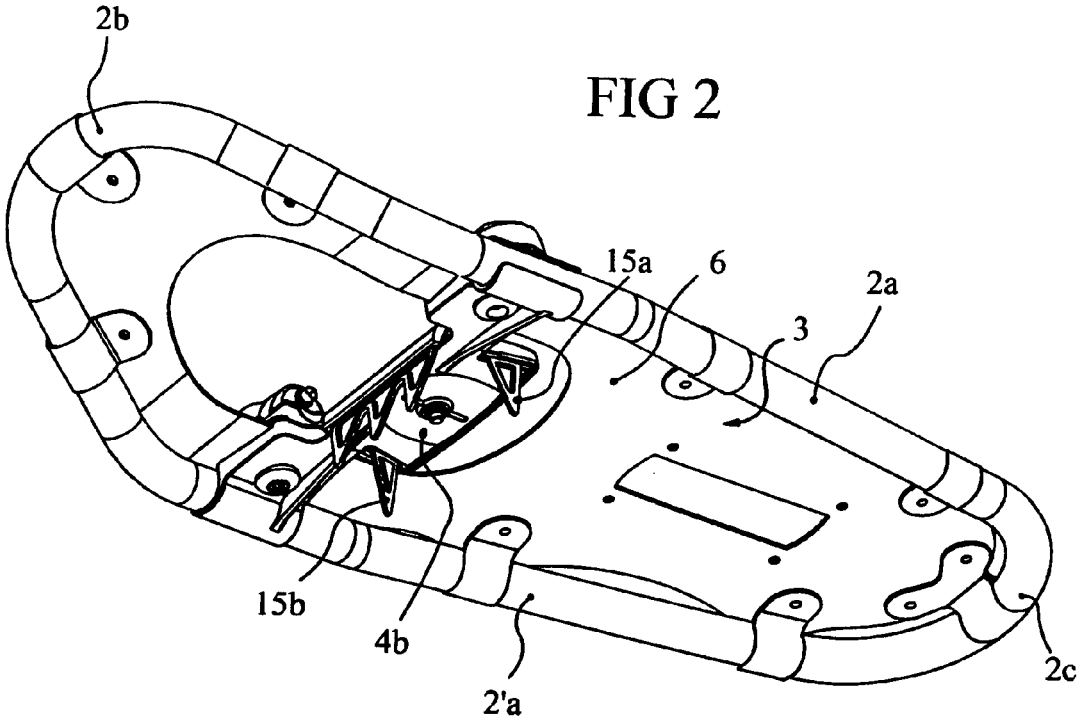
FIG. 2 is a perspective view from the front and below the snowshoe.
Figure 3:
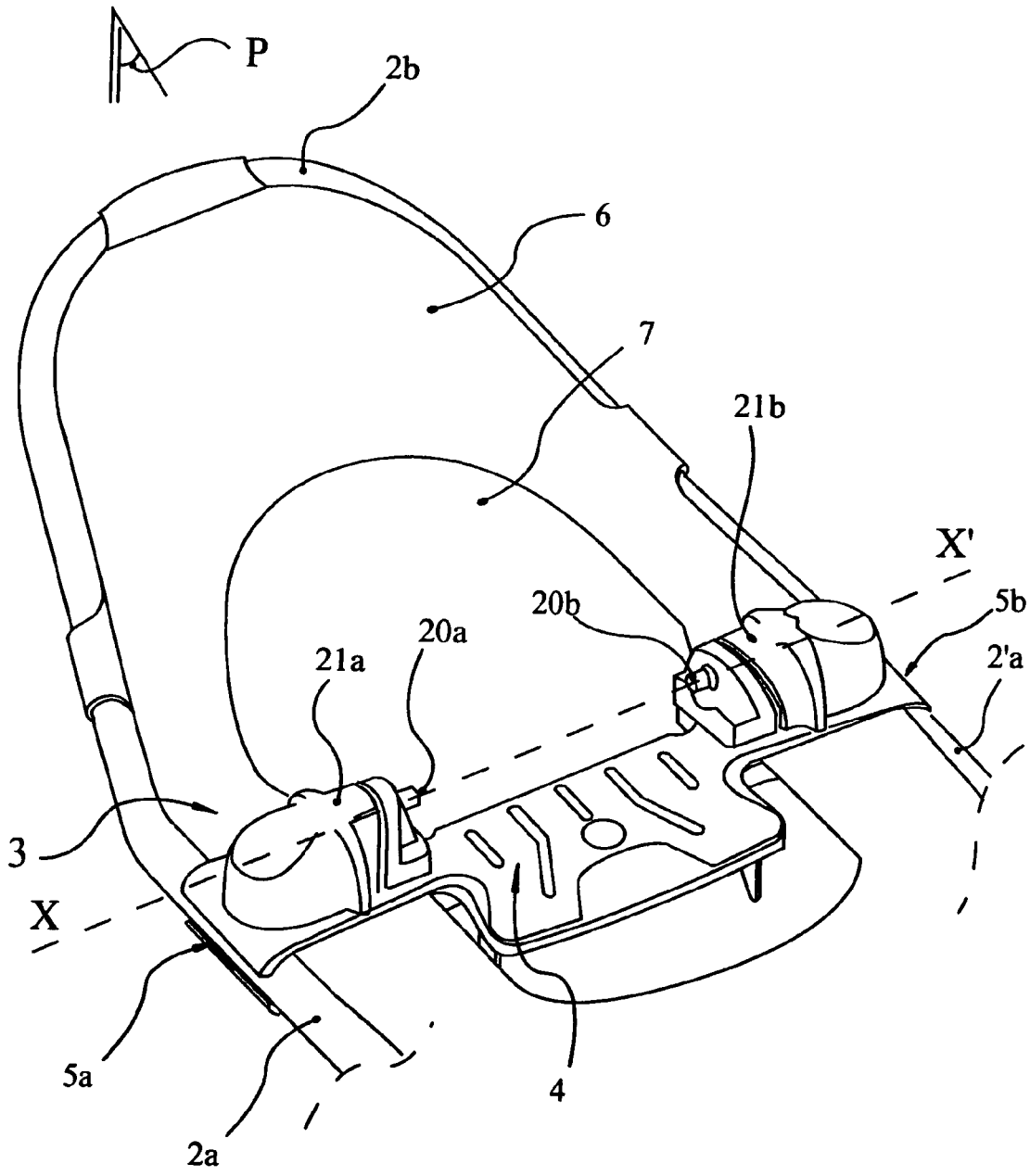
FIG. 3 is a perspective view of the front of the snowshoe in enlarged scale.
Figure 4:
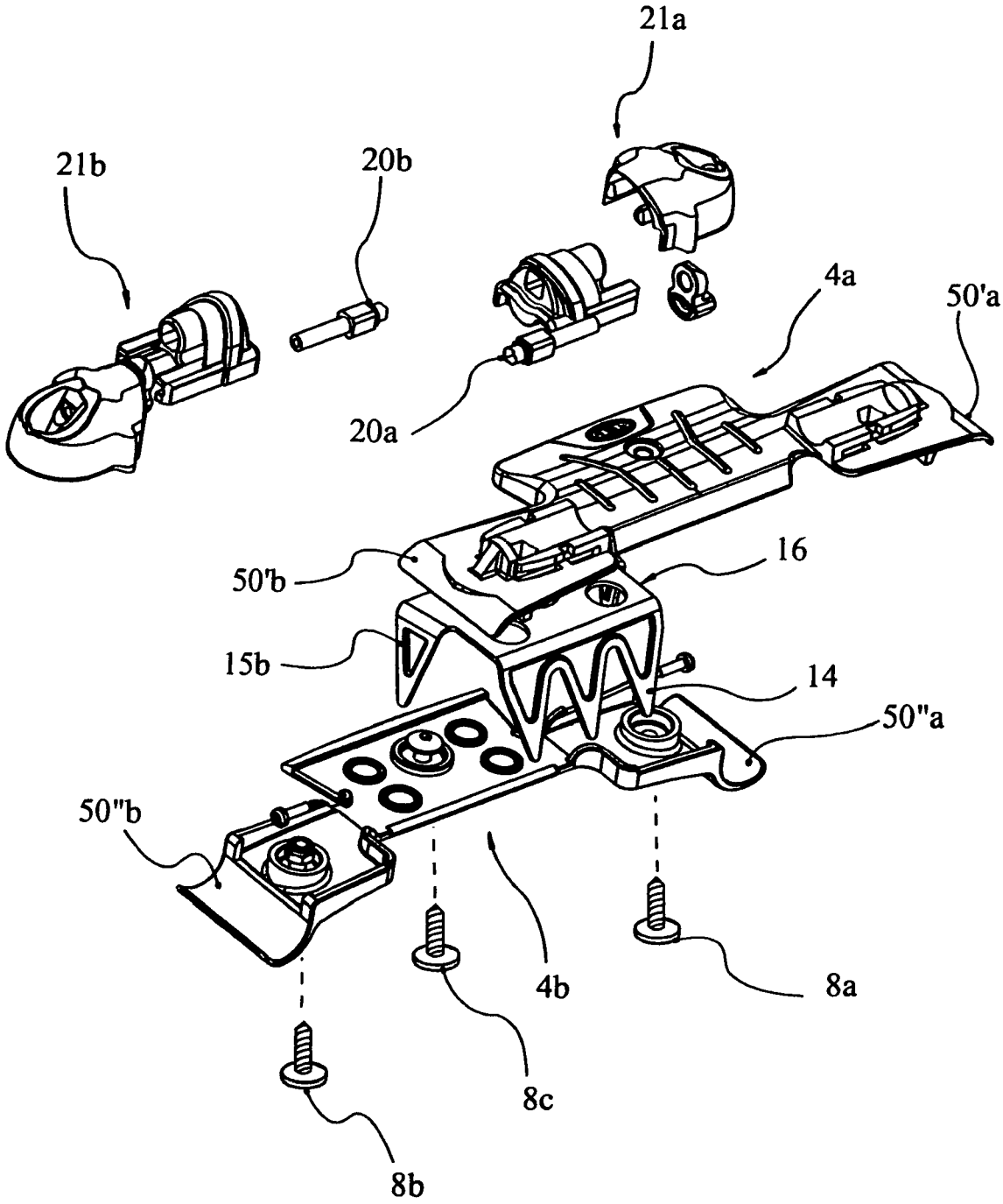
FIG. 4 is an expanded view illustrating the under transverse assembly and more particularly the various elements namely the transverse retaining element, the depending/catching means and the binding.
Figure 5:
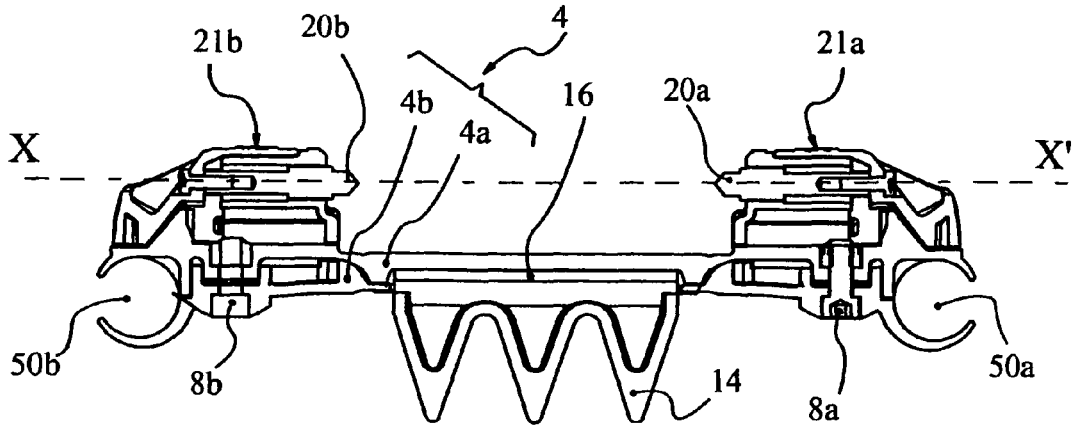
FIGS. 5, 6, 7 are respectively front (FIG. 5), rear (FIG. 6) and top (FIG. 7) views of the transverse assembly.
Figure 6:
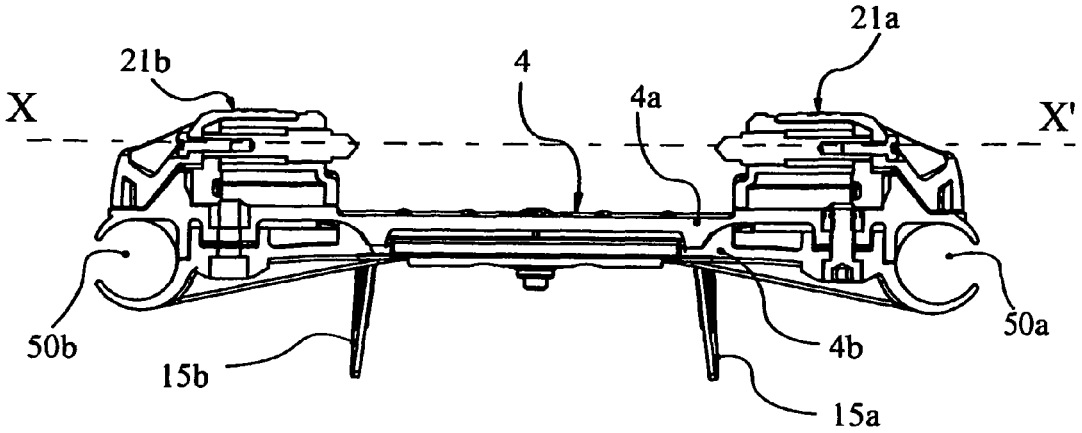
Figure 7:
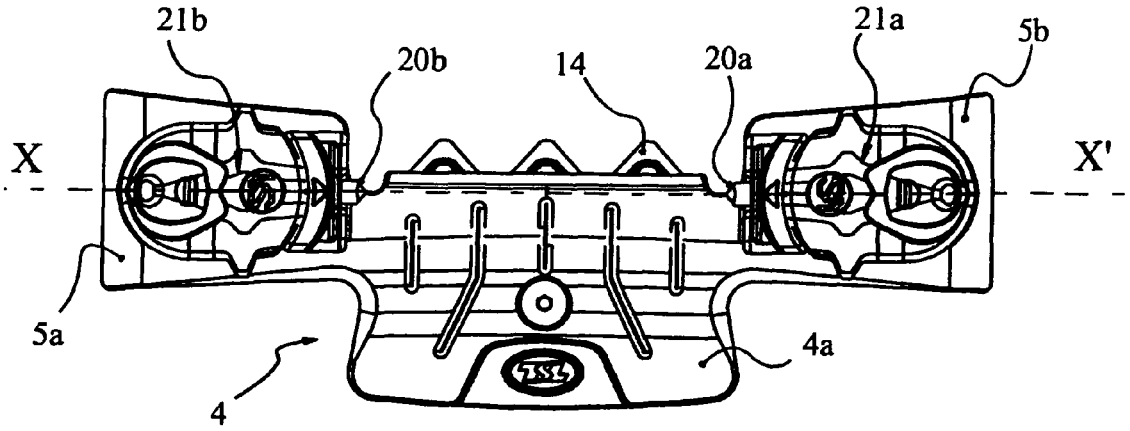

The snowshoe itself, carrying the general reference 1, is made up of a frame 2 surrounding a deck 3 intended to receive the boot of the user, said boot being retained on the deck by a binding, which is for example a pivoting plate or the like, to see a direct connection with the boot such as is described in French patent application No. 0 107 213. Said binding is at least in part attached on a transverse retaining element 4, extending transversely and retained by its lateral ends 5*a*, 5*b* to the frame 2.

The invention will be described below and referencing FIGS. 1 to 7, with a snowshoe of the type having a tubular frame and a deck made of a flexible wall, whereas the binding for the boot is of the type already described in French patent application No. 0 107 213, however it can of course be another, and like for example the alternative illustrated in FIG. 8.

The deck 3 is for example at least partially made up of a flexible wall which we will call the continuous fabric 6 the border of which is configured to be attached to the frame 2 in a plurality of places with the assistance of mounting means, such as that which is described for example in French patent application No. 0 600 328. Said flexible wall is for example made up entirely of a plastic material, or others such as leather, or fabric of any type.

The frame 2 is advantageously made of a peripheral metallic tube 20, for example of aluminum or the like such as steel or plastic material or composite material. Of course, one will not depart from the invention if the peripheral frame is not complete or closed on all sides. It also follows that the profile from which the frame is made can just as well be made of another cross section than that of a cylindrical tube.

According to one embodiment of the snowshoe 1 according to the invention, it has advantageously a longitudinal, vertical plane of general symmetry P. It follows as well that the snowshoe can be nonsymmetrical without departing from the framework of the invention.

The peripheral tubular body 2 has an elongated form, and comprises two lateral tubular portions 2*a*, 2'*a* connected at the front AV by a front tubular portion 2*b* extending the tubes laterally and forming a spatula 5 advantageously raised, in which the lateral tubes 2*a*, 2'*a* are connected at the rear AR by a rear tubular portion 2*c*.

The fabric 6 making up the deck which has overall the general shape of the interior of the frame 2, includes to the front a central front hole 7 in order to permit the passage of the front of the boot during its pivoting around the axis XX'.

According to the invention the transverse retaining element 4 is made up of an assembly of an upper transverse element 4*a* and a lower transverse element 4*b*. Also the two transverse elements 4*a*, 4*b* are attached together by attaching screws or the like such as rivets or the like 8*a*, 8*b*, 8*c*.

One will note that at least the lower transverse element 4*b* is made of a plastic material as could the two transverse elements namely the upper transverse element 4*a* and the lower transverse element 4*b*.

One will note that the transverse retaining element 4, which extends transversely is attached by its lateral ends 5*a*, 5*b* to the frame 2. Also, each of the lateral ends 5*a*, 5*b* is attached on the corresponding portions of the lateral tubes 2*a*, 2'*a* by virtue of the association of the upper transverse element 4*a* and the lower transverse element 4*b*, and by cooperation of the shapes with the tube. In other words the frame 2 and more particularly the tube is sandwiched between the ends of one part of the upper transverse element 4*a* and the other part of the lower transverse element 4*b*.

Note also that the transverse element 4 extends at the level of the toe of the boot of the user, that is to say at the level of the transverse pivot axis XX' of the foot.

Also, once the two transverse elements 4*a*, 4*b* are affixed together each of their lateral ends forms a retention housing 50*a*, 50*b* in which the corresponding lateral portion of the tube is retained.

One understands that the transverse element 4 is made up of the combination of an upper transverse element 4*a* and a lower transverse element 4*b* such that the frame 2 will be sandwiched between the respective ends 50'*a*, 50"*a*, 50'*b*, 50"*b* of said transverse elements 4*a*, 4*b*.

The snowshoe of the invention includes moreover gripping means, comprising at least one depending tooth 14, 15*a*, 15*b*.

Also the depending means 13 are made up for example of in part by a series of front teeth 14 and in part by two lateral teeth 15*a*, 15*b*.

The series of front teeth 14 and the two lateral teeth 15*a*, 15*b* are formed by downward extensions of a lower plate 16, for the series of front teeth and by the lateral extensions from this base plate. Of course these extensions extend downward to make a projection below the plane of general support of the snowshoe to permit a good grip during its utilization. Note that the base plate is advantageously made of aluminum or of steel such that the gripping teeth perform well their role of gripping and do not wear out too quickly.

Precisely according to one supplemental characteristic of the invention the base plate 16 is sandwiched between the central wall of the upper transverse element 4*a* and the central wall of the lower transverse element 4*b*.

One understands that the central wall the lower transverse element is covered in plastic material like the metalize base plate, such that the snow is not in contact with the base plate but with the central wall of the lower transverse element this which ordinarily retains an accumulation of snow under the base plate.

The binding illustrated by way of example is that described in French patent application No. 0 107 213, according to which the boot is configured to pivot around a transverse axis X,X' by virtue of the cooperation of the two lateral projections 20*a*, 20*b* extending towards the plane P configured to be engaged in the hollow profiles defined in the sole of the boot at the level of the metatarsals. The lateral projections 20*a*, 20*b* are retained in the supports 21*a*, 21*b* which are affixed on the transverse retaining element 4. According to the preferred embodiment the mounting of the supports 21*a*, 21*b* is achieved by virtue of the threaded fasteners 8*a*, 8*b* which assure also the mutual retention of the two transverse elements, that is the upper 4*a* and the lower 4*b*.

Of course the invention is not limited to the embodiment described and shown by the examples but it also includes all equivalent techniques and their combinations.

In this way, the peripheral frame 2 is, in the preferred embodiment, defined by a metallic tube, but it could be otherwise and be made by a non-tubular profile or non-metallic such as plastic material, without departing from the framework of the invention. Also the frame 2 made by a peripheral profile, can be made of two lateral profiles 2*a*, 2*a*' connected at the front by a portion of a front profile 2*b* forming a spatula 5 so that the lateral profiles 2*a*, 2'*a* are connected in the rear AR by a rear profile portion 2*c*.

Figure 8:
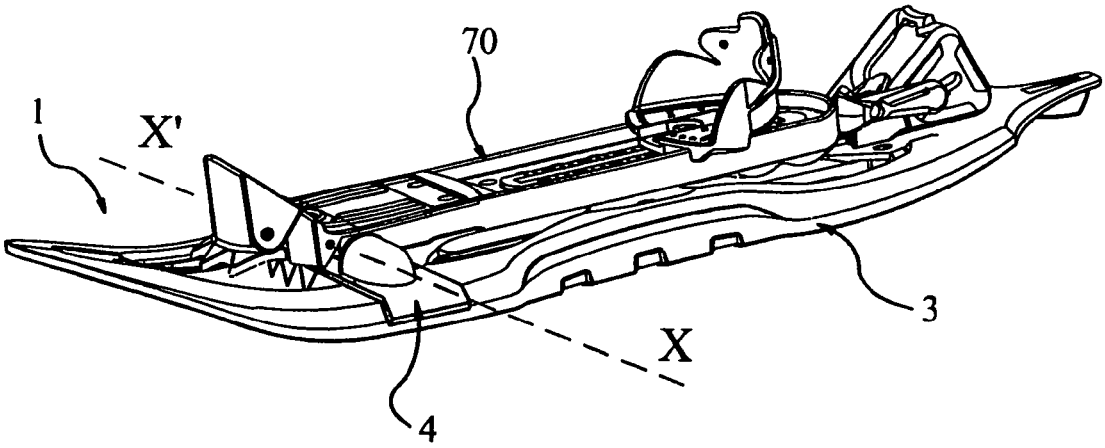
FIG. 8 illustrates an alternate embodiment.

FIG. 8, represents a variation according to which the snowshoe is of the type made of a deck defined for example in plastic material, in which the boot of the user is attached on the plate 70 mounted pivotally around a transverse axis X,X'.

In this way also the connection of the two transverse elements 4*a*, 4*b* made according to the described embodiment with threaded fasteners, could be provided by other connecting means, like for example rivets or another.

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. A snowshoe made of a frame holding a deck intended to receive the user's boot, the aforementioned boot being retained on the deck by a binding, the snowshoe including a transverse retaining element, this transverse element being at the front of the user's foot, the aforementioned transverse element being held by its lateral ends to the frame, while the aforementioned transverse element is made of an upper transverse element and a lower transverse element so that the frame is sandwiched between respective ends of the aforesaid transverse elements.

2. The snowshoe according to claim 1, wherein ends of the two transverse elements form a holding place in which the frame is held.

3. The snowshoe according to claim 1, further including at least one one gripping tooth which is an extension of a base plate which is sandwiched between a central wall of the upper transverse element and central wall of the lower transverse element.

4. The snowshoe according to claim 3, wherein the base plate includes a succession of front teeth, formed by an extension of the aforesaid base plate, extending toward the ground under a general plane of the snowshoe.

5. The snowshoe according to claim 3, wherein the base plate includes two lateral teeth, formed by a lateral extension of the aforesaid base plate, extending toward the ground and under a general plane of the snowshoe.

6. The snowshoe according to claim 1, wherein at least the lower transverse element is made of plastic.

7. The snowshoe according to claim 6, wherein the base plate is made of metal.

8. The snowshoe according to claim 6, wherein the upper transverse element is made of plastic.

9. The snowshoe according to claim 1, wherein the frame makes a peripheral profile, including two sides connected at the front by a front profile forming a spatula, while the sides are connected in the rear by a rear profile.

10. The snowshoe according to claim 1, wherein the lower transverse element and the upper transverse element, are held together by either bolts or rivets.

11. A snowshoe comprising:

a peripheral frame;

a deck attached to the peripheral frame, the deck defining an aperture configured to pass a toe of a user's boot;

an upper transverse element extending between upper opposite sides of the peripheral frame and extending adjacent the deck aperture;

a lower transverse element extending between lower opposite sides of the peripheral frame and extending parallel and below the upper transverse element;

at least one connecting element which connects the upper and lower transverse elements together, such that the peripheral frame is sandwiched between ends of the upper and lower transverse elements.

12. The snowshoe according to claim 10, wherein:

the ends of the upper transverse element define downward facing hollows of complementary shape to an upper side of the peripheral frame;

the ends of the lower transverse element define upward facing hollows of complementary shape to an lower side of the peripheral frame.

13. The snowshoe according to claim 11, further including:

a base plate sandwiched between the upper and lower transverse elements; and a binding mounted to the plate to receive the toe of the user's boot.

14. The snowshoe according to claim 13, wherein the base plate includes a pair of lateral depending teeth and at least one front depending tooth.

15. The snowshoe according to claim 13, wherein the base plate includes a plurality of downwardly depending teeth.

16. The snowshoe according to claim 15, wherein the base plate and the teeth are made of metal and at least one of the transverse elements is made of plastic.

* * * * *